US009279564B1

(12) United States Patent
Householder

(10) Patent No.: US 9,279,564 B1
(45) Date of Patent: Mar. 8, 2016

(54) INDIRECT AREA LIGHTING APPARATUS AND METHODS

(75) Inventor: John R. Householder, Cedar Park, TX (US)

(73) Assignee: Universal Lighting Technologies, Inc., Madison, AL (US)

( * ) Notice: Subject to any disclaimer, the term of this patent is extended or adjusted under 35 U.S.C. 154(b) by 548 days.

(21) Appl. No.: 13/584,525

(22) Filed: Aug. 13, 2012

Related U.S. Application Data

(60) Provisional application No. 61/522,534, filed on Aug. 11, 2011.

(51) Int. Cl.

| | |
|---|---|
| ***F21V 1/00*** | (2006.01) |
| ***F21V 11/00*** | (2015.01) |
| ***F21V 7/08*** | (2006.01) |
| ***F21V 7/00*** | (2006.01) |
| *F21K 99/00* | (2010.01) |
| *F21Y 101/02* | (2006.01) |

(52) U.S. Cl.
CPC ..... *F21V 7/08* (2013.01); *F21V 7/0025* (2013.01); *F21K 9/00* (2013.01); *F21K 9/50* (2013.01); *F21Y 2101/02* (2013.01)

(58) Field of Classification Search
CPC ..... F21Y 2101/02; F21K 9/50; F21K 9/00
USPC ..... 362/235, 240, 362, 311.02, 297, 245, 362/249.02, 247, 241, 308, 327, 800
See application file for complete search history.

(56) References Cited

U.S. PATENT DOCUMENTS

| | | | | |
|---|---|---|---|---|
| 3,323,091 | A | | 5/1967 | Hibbits |
| 5,075,827 | A | * | 12/1991 | Smith ..... 362/221 |
| 5,839,823 | A | | 11/1998 | Hou et al. |
| 6,257,737 | B1 | | 7/2001 | Marshall et al. |
| 6,312,144 | B1 | | 11/2001 | Li |
| D541,467 | S | | 4/2007 | Gould |
| D541,468 | S | | 4/2007 | Mayfield, III et al. |
| D544,633 | S | | 6/2007 | Mayfield, III et al. |
| D544,634 | S | | 6/2007 | Mayfield, III et al. |
| D544,992 | S | | 6/2007 | Mayfield, III et al. |
| 7,229,192 | B2 | | 6/2007 | Mayfield, III et al. |
| 7,229,194 | B2 | | 6/2007 | Liu et al. |
| 7,510,305 | B2 | | 3/2009 | Straton et al. |
| 7,585,096 | B2 | | 9/2009 | Fallahi et al. |
| D603,999 | S | | 11/2009 | Fowler, Jr. et al. |
| D604,446 | S | | 11/2009 | Fowler, Jr. et al. |
| 7,690,814 | B2 | | 4/2010 | Saccomanno et al. |
| 7,874,704 | B2 | | 1/2011 | Falicoff et al. |
| 2009/0141487 | A1 | | 6/2009 | Gould et al. |

(Continued)

*Primary Examiner* — Anh Mai
*Assistant Examiner* — Jessica M Apenteng
(74) *Attorney, Agent, or Firm* — Patterson Intellectual Property Law, P.C.; Mark J. Patterson; Jerry Turner Sewell

(57) ABSTRACT

A lighting fixture apparatus includes a light source oriented toward a illumination area. A primary reflector is disposed between the light source and the illumination area. The primary reflector includes a primary concave surface substantially facing away from the illumination area. A secondary reflector is positioned opposite the primary concave surface and includes a secondary concave surface substantially facing toward the illumination area. The primary concave surface is substantially specularly reflective, and the secondary concave surface is substantially diffusely reflective. In some embodiments, only reflected light is visible from the illumination area, and no direct light from the light source is incident on the illumination area.

19 Claims, 4 Drawing Sheets

(56) References Cited

U.S. PATENT DOCUMENTS

| | | | | |
|---|---|---|---|---|
| 2010/0172152 | A1 | 7/2010 | Boonekamp | |
| 2010/0182782 | A1 | 7/2010 | Ladewig | |
| 2010/0265703 | A1 | 10/2010 | Hall et al. | |
| 2010/0271843 | A1 | 10/2010 | Holten et al. | |
| 2010/0290222 | A1 | 11/2010 | Pickard et al. | |
| 2011/0110081 | A1* | 5/2011 | Belknap et al. | 362/235 |
| 2011/0133225 | A1 | 6/2011 | Jurik | |
| 2011/0164398 | A1 | 7/2011 | Holten et al. | |
| 2011/0170298 | A1* | 7/2011 | Anaokar et al. | 362/297 |

* cited by examiner

INDIRECT AREA LIGHTING APPARATUS AND METHODS

CROSS-REFERENCES TO RELATED APPLICATIONS

This patent application claims domestic priority to U.S. Provisional patent application Ser. No. 61/522,534 filed Aug. 11, 2011 titled "Indirect Area Lighting System" all of which is hereby incorporated by reference in its entirety.

BACKGROUND OF THE INVENTION

This invention pertains to indirect area lighting devices and more particularly to overhead luminaire, or troffer, lighting fixtures and associated housings, reflectors, and methods for providing area lighting.

Lighting devices including one or more light emitters and associated reflectors for distributing light in an area are generally known in the art for various applications such as indoor and exterior lighting in buildings and automobiles. Such devices may be referred to generally as a luminaire or a troffer in some applications. Conventional luminaire devices typically house one or more light sources such as incandescent bulbs or light emitting diode emitters. Light from each light source travels away from the luminaire toward an area to be illuminated. In many applications, conventional devices allow light from the light source to travel directly to the area to be illuminated. However, such direct illumination may cause one or more areas of high intensity, or bright spots, near the light source when the lighting fixture is viewed from the illumination area. These variations in intensity can be unpleasing to the eye and may cause uneven light distribution, resulting in more illumination near the light source and less illumination farther away from the light source.

To overcome these problems, others have attempted to provide lighting fixtures including housings having one or more reflectors and/or lenses positioned near a light source in an attempt to more evenly distribute emitted light. Such reflectors can cause some of the emitted light to travel in a more even distribution away from the light source. However, conventional lighting fixtures of this type generally reduce the optical efficiency of the lighting device. In many applications, as little as 50% of the lighting energy emitted from each light source becomes incident upon the area to be illuminated. Such losses are inefficient and are generally undesirable. To overcome this problem, some conventional luminaire devices allow direct light illumination from the light source. However, as previously noted, emission of light directly from the light source into the illumination area is generally undesirable in many applications. Thus, conventional devices struggle to balance reduction or elimination of direct light with optical efficiency.

What is needed then are lighting devices, reflectors, housings and methods of lighting to improve optical efficiency while using indirect illumination.

BRIEF SUMMARY OF THE INVENTION

In some embodiments, the present invention provides a lighting fixture apparatus including a light source configured to emit light in a first direction toward an illumination area. A primary reflector is disposed between the light source and the illumination area. The primary reflector includes a primary concave surface substantially facing the light source. The primary concave surface includes a specularly reflective portion. A secondary reflector including a secondary concave surface partially facing the primary concave surface. The secondary concave surface includes a diffusely reflective portion.

In additional embodiments, the present invention provides a lighting fixture apparatus including a light source configured to emit light in a first direction toward an illumination area. A primary reflector is disposed between the light source and the illumination area. The primary reflector includes a primary concave surface having a specular reflectivity. In some embodiments, the primary concave surface faces substantially away from the illumination area. A secondary reflector positioned opposite the primary reflector includes a secondary concave surface having a diffuse reflectivity. The secondary concave surface faces substantially toward the illumination area in some embodiments. No light from the light source is directly incident on the illumination area in some embodiments.

In further embodiments, the present invention provides a lighting fixture apparatus for lighting an illumination area. The invention includes a light source and a primary reflector positioned opposite the light source. The primary reflector includes a substantially specular primary reflective surface facing the light source such that light from the light source is incident on, or collected by, the primary reflective surface. A secondary reflector is positioned opposite the primary reflector. The secondary reflector includes a substantially diffuse secondary reflective surface positioned to receive light reflected from the primary reflector and to distribute the reflected light in a diffuse manner toward the illumination area.

Another object of the present invention in some embodiments is to provide a compound elliptical concentrator having first and second elliptical reflectors arranged such that light from a light source is concentrated on the first elliptical reflector and is subsequently reflected to the second elliptical reflector for reflective distribution to an illumination area. The first elliptical reflector includes a specularly reflective surface, and the second elliptical reflector includes a diffusely reflective surface. Additionally, light directly from the light source is blocked from reaching the illumination area by the first and/or second elliptical reflectors.

A further object of the present invention is to provide a troffer lighting fixture for overhead lighting applications having a uniform light distribution profile and an improved lit appearance.

Another object of the present invention is to provide a luminaire having primary and secondary reflectors such that no light emitted from the luminaire is directly from a light source.

Yet another object of the present invention is to provide a method of lighting an illumination area. The method includes the steps of emitting light from a light source, collecting the emitted light on an elliptical specular primary reflector, reflecting the emitted light from the primary reflector to an elliptical diffuse secondary reflector, and distributing the reflected light toward the illumination area.

Numerous other objects, features and advantages of the present invention will be readily apparent to those skilled in the art, upon a reading of the following disclosure, when taken in conjunction with the accompanying drawings.

DETAILED DESCRIPTION OF THE INVENTION

Figure 1:
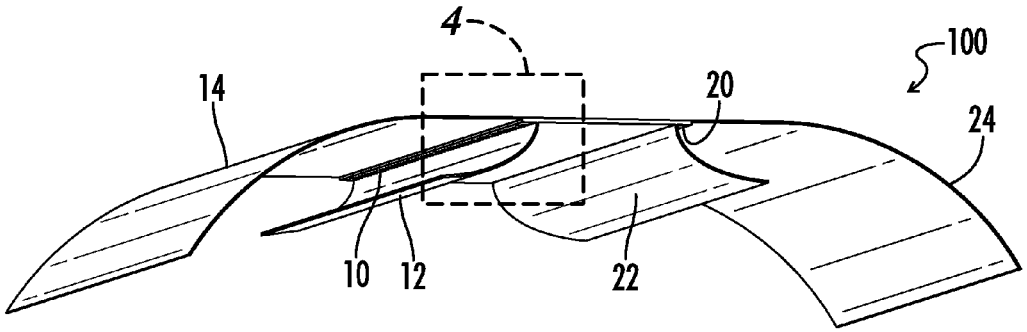
FIG. 1 illustrates a perspective view of an embodiment of a lighting fixture in accordance with the present invention.

Referring now to the drawings, various embodiments of the invention are generally illustrated. In some embodiments, a lighting device 100, seen in FIG. 1, includes a light source 10, a primary reflector 12, and a secondary reflector 14. As seen in FIG. 1, primary reflector 12 may be positioned below light source 10 such that light emitted from light source 10 will be incident upon primary reflector 12 and then bounce upwardly away from primary reflector 12 back generally toward light source 10. The reflected light leaving primary reflector 12 will then be incident upon secondary reflector 14 and subsequently be reflected downwardly away from lighting device 100.

Direct light is generally referred to as light incident on an area travelling directly from the light source 10. Indirect light is generally referred to as light incident on an area that has been emitted from the light source and has bounced off at least one surface. As such, in some embodiments, light emitted from lighting device 100 and incident upon a desired illumination area may be characterized as indirect light because the light is not emitted directly from light source 10 but is rather reflected off one or more reflectors prior to reaching the illumination area.

Figure 2:
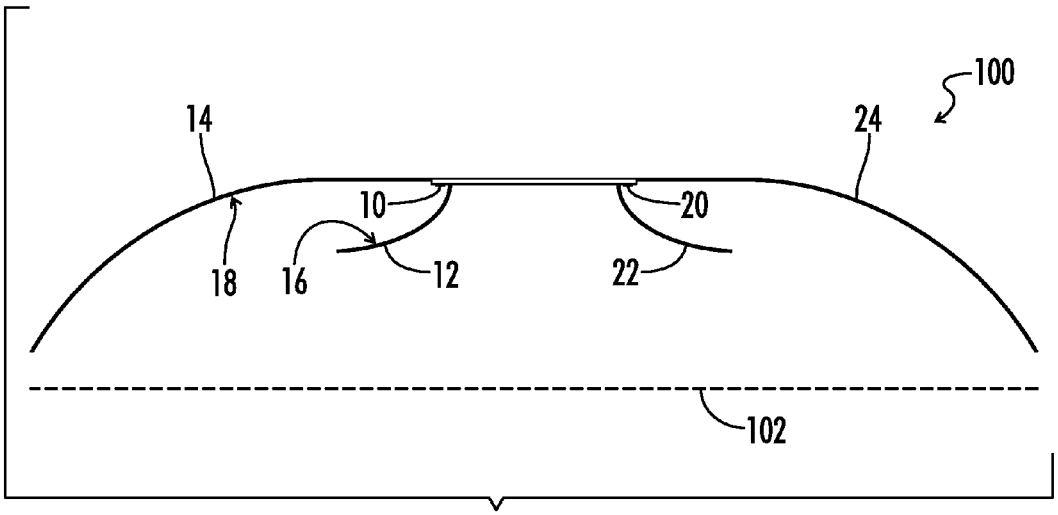
FIG. 2 illustrates a partial cross-sectional view of the embodiment of a lighting fixture of FIG. 1.
Figure 3:
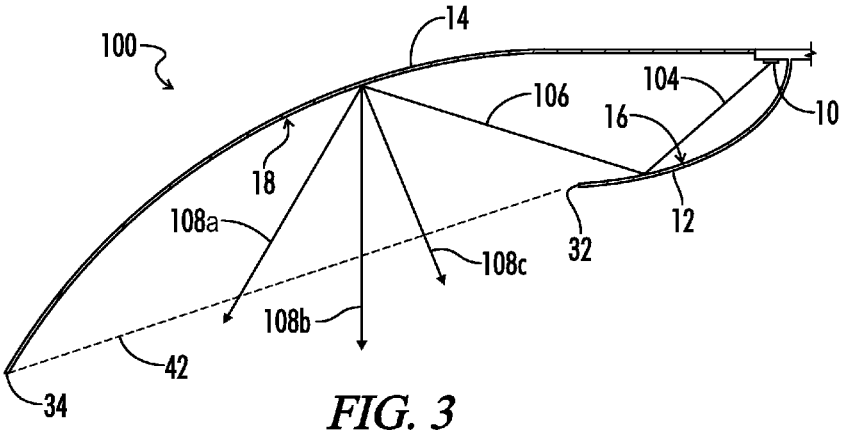
FIG. 3 illustrates a detail partial cross-sectional view of the embodiment of a lighting fixture of FIG. 2.

Primary reflector 12 in some embodiments has a generally concave shape, as seen in more detail in FIG. 2 and FIG. 3. Primary reflector 12 may have a primary concave surface 16 facing in the direction of the light source 10 such that light emitted from light source 10 will be incident upon primary concave surface 16. In some embodiments, primary concave surface 16 has a smoothly curved profile. In other embodiments, primary concave surface 16 includes a plurality of discrete flat sections adjacent one another to form a concave profile.

Secondary reflector 14 in some embodiments also has a generally concave shape. Secondary reflector 14 includes a secondary concave surface 18 partially facing the primary concave surface 16 on primary reflector 12. Secondary concave surface 18 generally faces downwardly substantially toward an illumination area 102 in some embodiments. The illumination area 102 may include a reference plane positioned at a specific location in relation to lighting 100 depending on the lighting application. In some embodiments, illumination area 102 includes an area below a lighting device 100. Illumination area 102 can include a room or a portion of a room in some applications.

Each concave surface is generally described as facing a direction relative to some other feature or reference. A concave surface may be identified as facing a feature or reference when the surface is oriented at an angle relative to the surface or feature. A surface does not have to be oriented normal to a feature or reference to be characterized as facing generally toward the feature or reference.

Primary reflector 12 having a primary concave surface 16 includes a first specular reflective region, or first specular reflective surface, in some embodiments. As such, primary concave surface 16 provides substantially specular reflectivity. Specular reflectivity is understood to mean that light incident from a single first direction is reflected in a single second direction. Specular primary reflector 12 can include a mirrored or polished primary concave surface 16 to achieve substantially specular reflectivity in some embodiments. Primary concave surface 16 does not have to be an ideal specular reflector to have a substantially specular reflectivity. By providing a primary concave surface 16 with a substantially specular reflectivity, the intensity of the incident light from light source 10 and reflected to diffuse secondary reflector 14 may be maintained. In some embodiments, primary concave surface 16 may be considered to have a substantially specular reflective surface when the surface is more specular than diffuse.

Secondary reflector 14 includes a secondary concave surface 18 including a first diffuse reflective region in some embodiments. Secondary concave surface 18 has a substantially diffuse reflectivity. Diffuse reflectivity is understood to mean that light incident from a single first direction is reflected in more than one direction. As such, the intensity of each diffusely reflected ray of light will be less than the intensity of the incident ray, and the diffusely reflected rays will travel in different directions. In additional embodiments, secondary concave surface 18 may include a combination diffuse and specular surface wherein a portion of incident light is emitted in a specular manner while another portion of incident light is reflected in a plurality of diffuse rays.

For example, FIG. 3 illustrates an embodiment of a lighting device 100 including a primary reflector 12 and a secondary reflector 14. An emitted ray 104 travels from light source 10 toward and is incident upon primary concave surface 16. The emitted ray 104 is reflected from primary concave surface 16 in a single direction as reflected ray 106. Reflected ray 106 travels toward and is incident upon diffuse secondary concave surface 18. Due to the diffusivity of secondary concave surface 18, reflected ray 106 is broken into a plurality of diffuse rays 108*a*, 108*b*, 108*c* reflected from secondary reflector 14 and different angles. The diffuse rays 108*a*, 108*b*, 108*c*, etc. are used to illuminate the illumination area below lighting device 100.

By combining a specular primary reflector 12 with a diffuse secondary reflector 14, it is possible to improve overall lighting troffer optical efficiency while also improving lit appearance and avoiding bright spots. In some embodiments, a lighting fixture 100 in accordance with the present disclosure exhibits about 89% efficiency with no degradation of light distribution uniformity.

In additional embodiments, primary reflector 12 can include a diffuse primary concave surface 16 and secondary reflector 14 includes a diffuse secondary concave surface 18. As such, the diffuse primary and diffuse secondary reflector arrangement can produce a desired lighting effect in some applications. Also, in some additional embodiments, both primary and secondary reflectors may include a specular reflective surface.

Referring further to FIGS. 1-3, in some embodiments, primary reflector 12 has an elliptical cross-sectional profile. An elliptical cross-sectional profile provides a curved reflective surface, wherein the curvature of the reflective surface includes a region corresponding substantially to a portion or segment of an ellipse. The entire reflective surface need not be elliptical for the reflector to have an elliptical cross-sectional profile. Rather, an elliptical cross-sectional profile may be achieved where only a portion of the reflector, or the reflective surface, has a curvature corresponding to the shape of a segment of an ellipse.

An elliptical cross-sectional profile allows an optimal pattern of emitted light to be reflected to secondary reflector 14 in some embodiments. Primary reflector 12 can include a smoothly-curved shape corresponding to a portion of an ellipse in some embodiments. In other embodiments, primary reflector 12 includes a plurality of discrete flat or linear sections combined to form a composite elliptical shape. In various embodiments, secondary reflector 14 also includes an elliptical cross-sectional profile. As such, elliptical secondary reflector 14 may achieve an optimal pattern of reflected diffuse light for illuminating the illumination area 102. Secondary reflector 14 can also include a smoothly curved shape or a plurality of discrete flat or linear sections combined to form a composite elliptical shape.

In other applications, various other geometrical shapes may provide enhanced reflection patterns for primary and secondary reflectors 12, 14. For example, in some embodiments, primary reflector 12 and/or secondary reflector 14 include a cross-sectional profile corresponding to a portion of a parabola. Various other suitable geometric shapes may also be used in other embodiments.

Referring again to FIG. 1, in some embodiments, lighting fixture 100 has an elongated profile having a substantially rectangular footprint. As such, lighting fixture 100 can be modularly installed in a lighting assembly for volume lighting applications such as a commercial overhead lighting application.

In some applications, lighting fixture 100 includes two rows of emitters arranged beside one another. This type of arrangement provides dual lighting capability and generally provides more lighting across a larger illumination area. As seen in FIG. 1, lighting fixture 100 has a symmetrical profile including a second primary reflector 22 and a second secondary reflector 24. Second primary and secondary reflectors 22, 24 are arranged in a configuration identical to but opposite the first primary and secondary reflectors 12, 14. A second light source 20 is disposed between second primary reflector 22 and second secondary reflector 24 to emit light therebetween. Second light source 20 may include a linear array of light emitting diodes aligned substantially parallel to first light source 10 in some embodiments. Second primary reflector 22 includes a specular reflective concave surface facing away from illumination area 102, and second secondary reflector 24 includes a diffuse reflective concave surface facing substantially toward illumination area 102.

In some embodiments, first and second primary reflectors 12, 22 can be positioned horizontally adjacent to each other such that a single light source may simultaneously emit light onto both primary reflectors. In such embodiments, first and second primary reflectors 12, 22 can be integrally formed in a one-piece construction. First and second secondary reflectors 14, 24 can also be formed in an integral one-piece construction in some embodiments. In additional embodiments, lighting fixture 100 may have an axis-symmetric profile wherein primary reflector 12 and secondary reflector 14 both include a reflective surface having the shape of an ellipse segment swept about a central vertical axis.

Figure 4:
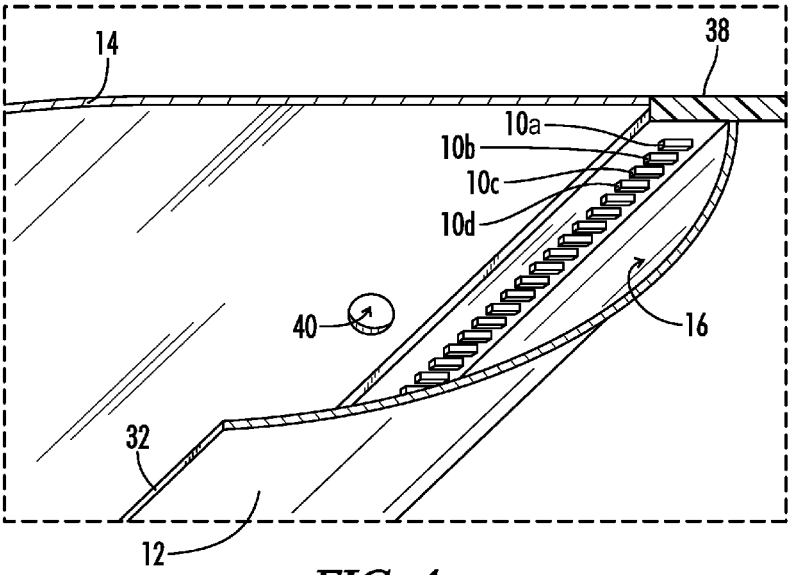
FIG. 4 illustrates a detail perspective view of the embodiment of a lighting fixture seen in Section 4 of FIG. 1.

Light source 10 can include any suitable light source known in the art. In some applications, it is generally desirable to use one or more light emitting diodes for light source 10. As seen in FIG. 4, in some embodiments, light source 10 includes a plurality of light emitting diodes 10*a*, 10*b*, 10*c*, 10*d*, etc. Each light emitting diode has a primary emission angle, and each primary reflector 12 includes dimensions, such that the emission of light is intercepted, or collected, by primary reflector 12. As such, primary reflector 12 blocks direct light from the light source from travelling directly to the illumination area, and only reflected light emitted from light source 10 is visible from illumination area 102. Light emitting diodes 10 can be arranged in a linear array on a printed circuit board 38 in some embodiments. Printed circuit board 38 may be pre-assembled with light emitting diodes 10 installed thereon and subsequently attached to secondary reflector 14, or positioned between primary and secondary reflectors 12, 14, in some embodiments. In other embodiments, primary and secondary reflectors may be mechanically fastened to printed circuit board 38.

As seen in FIG. 4, in some embodiments, one or more vents 40 are defined in secondary reflector 14. Each vent 40 provides a clearance passage for allowing heat to passively convect away from light source 10 and primary reflector 12. Vent 40 may also be defined as a gap between secondary reflector 14 and circuit board 38. Referring again to FIG. 3, in some embodiments, primary reflector 12 includes a primary reflector distal edge 32 projecting away from light source 10. Similarly, secondary reflector 14 also includes a secondary reflector distal edge 34 projecting away from light source 10. A window 42 is defined between primary reflector distal end 32 and secondary reflector distal end 34. During use, air may travel upwardly through window 42 to the space between primary and secondary reflectors 12, 14 and exit through one or more vents 40 to remove heat from the lighting fixture 100.

Figure 5:
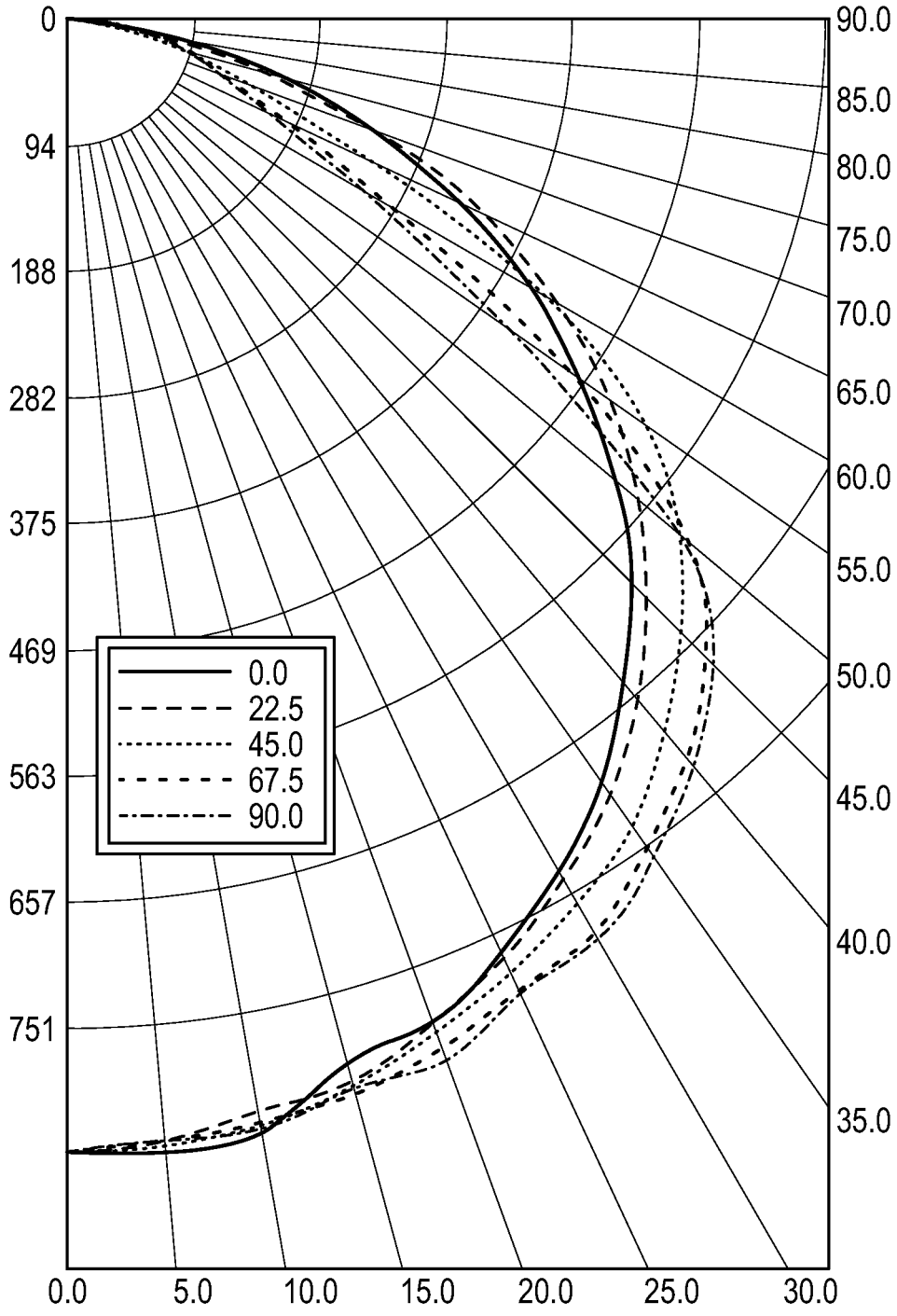
FIG. 5 illustrates an embodiment of a luminous intensity vs. angle graph showing lighting characteristics for various embodiments of the lighting fixture of the present invention.

An exemplary photometric chart showing luminous intensity as a function of viewing angle is seen in FIG. 5 for some embodiments of lighting fixture 100. As seen in the chart, intensity is optimized over a large range of viewing angles, providing enhanced lit appearance and lighting efficiency.

Another feature of the present invention provides a lighting fixture 100 that provides not only diffuse light over a wide range of viewing angles, but that also improves lit appearance by reducing areas of high intensity, or bright spots. This may be achieved in some applications by preventing light directly from the light source 10 from being incident up on the illumination area 102. In other words, in some embodiments, primary reflectors 12, 22 block light directly from light source 10 from reaching illumination area 102. As such, light directly from light source 10 is not visible from illumination area 10. This means only indirect light, i.e. reflected light, is visible from illumination area 10 in some embodiments. Additionally, by providing one or more primary reflectors that block direct light, it is possible to hide the internal components including the light source 10 from direct view when lighting fixture 100 is viewed from below. This is generally advantageous for improving the aesthetic appearance of the lighting fixture 100.

Figure 6:
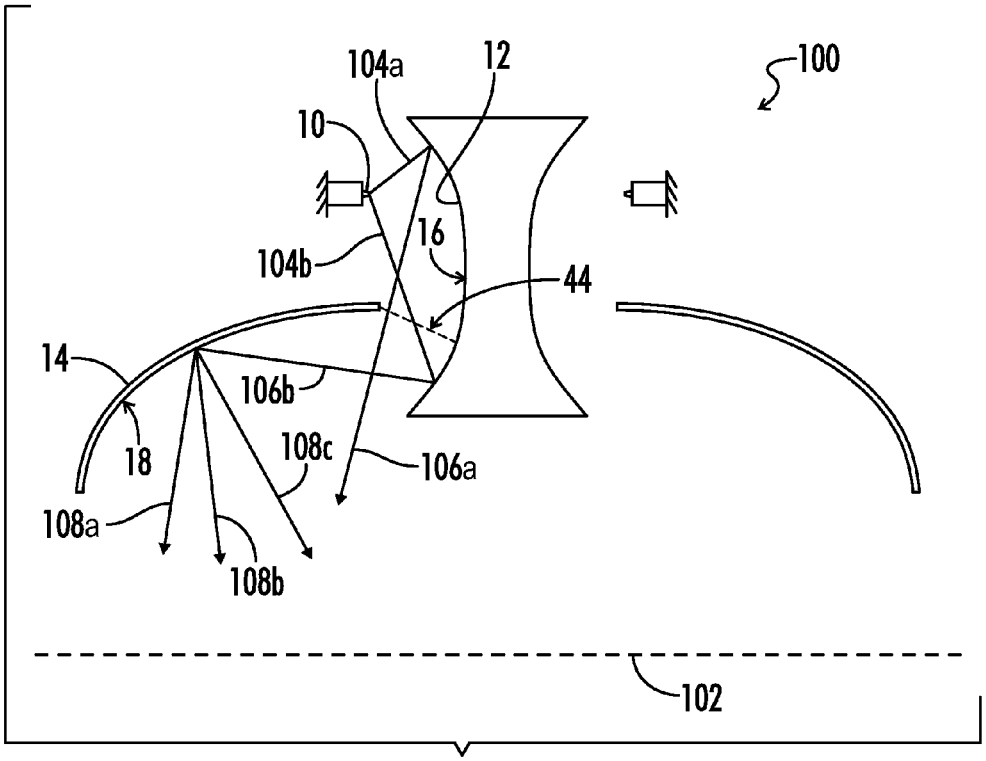
FIG. 6 illustrates an alternative embodiment of a lighting fixture in accordance with the present invention.

Referring now to FIG. 6, in some alternative embodiments, the primary reflector 12 may be positioned in a more vertical orientation. Light source 10 may be positioned such that light is emitted generally in a direction parallel or at an angle relative to illumination area 102. In such embodiments, a gap 44 may be defined between primary reflector 12 and secondary reflector 14. During use, air may travel upwardly through gap 44 and provide cooling for light source 10. Additionally, in some embodiments, both diffusely reflected light from secondary reflector 14 and specularly reflected light from primary reflector 12 may be incident on illumination area 102. For example, a first emitted ray 104*a* is reflected from primary reflector 12 at an angle such that first reflected ray 106*a* travels through gap 44 and is not incident on secondary reflector 14. Additionally, a second emitted ray 104*b* may be incident on primary reflector 12 at a different location such that second reflected ray 106*b* is reflected to secondary reflector 14 and is subsequently distributed as a plurality of reflected diffuse rays 108*a*, 108*b*, 108*c*, etc. toward illumination area 102. In additional embodiments, only diffuse reflected light from secondary reflector 14 is incident on illumination area 102.

In further embodiments, the present invention provides a method of illuminating an illumination area. The method includes the steps of: (a) collecting emitted light from a light source on a primary specularly reflective surface; (b) reflecting the emitted light from the primary specularly reflective surface toward a secondary diffusely reflective surface; and (c) distributing the light from the secondary diffusely reflective surface toward the illumination area. In some embodiments, the primary and secondary reflective surfaces have an elliptical cross-sectional profile. Additionally, in some embodiments, none of the emitted light from the light source is directly incident on the illumination area.

Thus, although there have been described particular embodiments of the present invention, it is not intended that such references be construed as limitations upon the scope of this invention except as set forth in the following claims.

What is claimed is:

1. An overhead lighting fixture apparatus for illuminating an illumination area below the lighting fixture apparatus and not above the lighting fixture apparatus, the lighting fixture apparatus comprising:

a light source configured to emit light to illuminate the illumination area;

a primary reflector disposed between the light source and the illumination area below the lighting fixture apparatus to intercept the light emitted by the light source, the primary reflector including a primary concave surface substantially facing the light source, the primary concave surface having substantially specular reflectivity, the primary reflector reflecting at least a first portion of the intercepted light in a direction away from the illumination area; and a secondary reflector including a secondary concave surface at least partially facing the primary concave surface to receive the first portion of the intercepted light from the primary concave surface, the secondary concave surface facing toward the illumination area, the secondary concave surface having substantially diffuse reflectivity, the secondary reflector reflecting the first portion of intercepted light toward the illumination area below the lighting fixture apparatus, the secondary reflector blocking the first portion of the intercepted light from illuminating any area above the lighting fixture apparatus, wherein the secondary reflector is positioned with respect to the primary reflector and the primary reflector is positioned with respect to the light source such that all light incident on the illumination area below the lighting fixture apparatus from the light source is reflected by at least one of the primary concave surface and the secondary concave surface.

2. The apparatus of claim 1, wherein the primary reflector includes an elliptical cross-sectional profile.

3. The apparatus of claim 2, wherein the secondary reflector includes an elliptical cross-sectional profile.

4. The apparatus of claim 1, wherein the primary reflector is configured to block light from the light source from reaching the illumination area directly.

5. The apparatus of claim 1, wherein the light source comprises a light emitting diode.

6. The apparatus of claim 1, wherein the light source comprises a plurality of adjacent light emitting diodes.

7. The apparatus of claim 1, wherein the light source includes a linear array of light emitting diodes.

8. The apparatus of claim 1, further comprising:

a printed circuit board positioned between the primary and secondary reflectors, wherein the light source is mounted on the printed circuit board.

9. The apparatus of claim 1, wherein the light source comprises an incandescent bulb.

10. The apparatus of claim 1, wherein the light source comprises a fluorescent bulb.

11. The apparatus of claim 1, further comprising:

the primary reflector having a primary distal edge extending away from the light source;

the secondary reflector having a secondary distal edge extending away from the light source; and a window defined between the primary distal edge and the secondary distal edge, wherein only the first portion of intercepted light reflected from the secondary reflector travels through the window toward the illumination area.

12. The apparatus of claim 1, further comprising:

the primary reflector having a primary distal edge extending away from the light source;

the secondary reflector having a secondary distal edge extending away from the light source;

an illumination window defined between the primary distal edge and the secondary distal edge;

wherein a second portion of the intercepted light reflected from the primary reflector travels through the illumination window toward the illumination area;

wherein the first portion of the intercepted light reflected from the secondary reflector travels through the illumination window toward the illumination area; and wherein substantially no light from the light source directly travels through the illumination window.

13. The apparatus of claim 1, further comprising at least one vent defined in the secondary reflector.

14. An overhead lighting fixture apparatus comprising:

a light source configured to emit light toward an illumination area below the lighting fixture apparatus;

a primary reflector disposed between the light source and the illumination area to intercept the light emitted by the light source, the primary reflector including a primary concave surface having a specular reflectivity; and a secondary reflector including a secondary concave surface having a diffuse reflectivity substantially facing toward the illumination area below the lighting fixture apparatus, the secondary concave surface at least partially facing the primary concave surface to receive light reflected by the primary reflector, the secondary reflector reflecting light received from the primary reflector toward the illumination area below the lighting fixture apparatus, the secondary reflector blocking the light received from the primary reflector from illuminating any area above the lighting fixture apparatus, wherein the primary reflector and the secondary reflector are positioned with respect to the light source so that all light propagating from the light source to the illumination area below the lighting fixture apparatus is reflected by at least one of the primary concave surface and the secondary concave surface such that substantially no light emitted from the light source is directly incident on the illumination area.

15. The apparatus of claim 14, wherein each of the primary and secondary concave surfaces has an elliptical cross-sectional profile.

16. The apparatus of claim 15, wherein the light source comprises a plurality of light emitting diodes.

17. An overhead lighting fixture apparatus for lighting an illumination area below the lighting fixture apparatus, the lighting fixture apparatus comprising:

a light source that emits light;

a primary reflector positioned proximate to the light source, the primary reflector including a concave substantially specular primary reflective surface facing the light source such that light from the light source is incident on the primary reflective surface and is reflected by the primary reflective surface as specularly reflected light; and a secondary reflector spaced apart from the primary reflector, the secondary reflector including a concave substantially diffuse secondary reflective surface positioned to face toward the illumination area below the lighting fixture apparatus and to at least partially face the primary reflective surface of the primary reflector to receive at least a first portion of the specularly reflected light reflected from the primary reflector and to reflect the first portion of the specularly reflected light toward the illumination area below the lighting fixture apparatus as diffusedly reflected light, the secondary reflective surface preventing the first portion of the specularly reflected light from illuminating any area above the lighting fixture apparatus, wherein the secondary reflector is positioned with respect to the primary reflector and the primary reflector is positioned with respect to the light source such that all light from the light source incident on the illumination area below the lighting fixture apparatus is reflected by at least one of the primary reflective surface or the secondary reflective surface.

18. The apparatus of claim 17, wherein the concave primary reflective surface and the concave secondary reflective surface each includes an elliptical cross-sectional profile.

19. The apparatus of claim 17, wherein both a second portion of specularly reflected light from the primary reflector and the diffusedly reflected light from the secondary reflector are incident on the illumination area.

* * * * *